US009135899B2

(12) United States Patent
Jones

(10) Patent No.: US 9,135,899 B2
(45) Date of Patent: Sep. 15, 2015

(54) EXTERNAL DRUM RING CONTROL (EDRC)

(71) Applicant: Keith Jones, Rancho Cucamonga, CA (US)

(72) Inventor: Keith Jones, Rancho Cucamonga, CA (US)

( * ) Notice: Subject to any disclaimer, the term of this patent is extended or adjusted under 35 U.S.C. 154(b) by 0 days.

(21) Appl. No.: 14/161,130

(22) Filed: Jan. 22, 2014

(65) Prior Publication Data

US 2015/0221291 A1 Aug. 6, 2015

Related U.S. Application Data

(60) Provisional application No. 61/849,597, filed on Jan. 30, 2013.

(51) Int. Cl.
*G10D 13/02* (2006.01)

(52) U.S. Cl.
CPC ..... *G10D 13/022* (2013.01)

(58) Field of Classification Search
CPC ..... G10D 13/022
See application file for complete search history.

(56) References Cited

U.S. PATENT DOCUMENTS

| | | | | | |
|---|---|---|---|---|---|
| 2,078,004 | A * | 4/1937 | Lebow | 84/411 R |
| 4,154,137 | A * | 5/1979 | Kobayashi | 84/411 R |
| 4,325,281 | A * | 4/1982 | Hardy | 84/411 M |
| 4,567,807 | A * | 2/1986 | Robinson | 84/411 M |
| 4,671,158 | A * | 6/1987 | Saputo | 84/411 M |
| 4,899,635 | A * | 2/1990 | Santangelo | 84/411 M |
| 5,877,440 | A * | 3/1999 | Chaffee et al. | 84/411 M |
| 5,892,168 | A * | 4/1999 | Donohoe | 84/411 M |
| 6,307,133 | B1 * | 10/2001 | May et al. | 84/411 M |
| 6,696,630 | B2 * | 2/2004 | Gatzen | 84/411 M |
| 8,410,345 | B2 * | 4/2013 | Patrick | 84/411 M |
| 8,541,675 | B2 * | 9/2013 | Strickland | 84/411 M |
| 8,962,962 | B2 * | 2/2015 | Jones | 84/411 R |
| 2006/0065099 | A1 * | 3/2006 | Anderson | 84/411 M |
| 2008/0264233 | A1 * | 10/2008 | Gatzen | 84/411 M |

OTHER PUBLICATIONS

"The Rogers Book", Cook R., Second Edition, Nov. 1999, p. 223, Rebeats Publications, Alma, USA.

* cited by examiner

*Primary Examiner* — Robert W Horn
(74) *Attorney, Agent, or Firm* — Blair Walker IP Services, LLC

(57) ABSTRACT

An adaptor for reducing acoustic ringing of a drum head of a drum having a shell and a rim includes a monolithic body having a clip portion and a contact portion, the clip portion configured to extend around an outer section of the rim between a top surface of the drum head and a bottom portion of the rim, wherein the contact portion comprises a contact surface configured to apply a pressure to a portion of the top surface of the drum head when the clip portion is coupled to the drum.

20 Claims, 2 Drawing Sheets

EXTERNAL DRUM RING CONTROL (EDRC)

CROSS-REFERENCE TO THE RELATED APPLICATIONS

This application claims priority to the U.S. Provisional Application Ser. No. 61/849,597 filed on Jan. 30, 2013, entitled "External Drum Ring Control—EDRC," which is incorporated herein by reference in its entirety for all purposes. Priority is claimed pursuant to 35 U.S.C. 119.

SUMMARY OF THE INVENTION

It is a major object of the invention to provide an improved apparatus, referred to as EDRC, for use in stopping the ring that occurs when a drum head has nothing on the outer part of the playing service; ERDC stops this from happening.

For combination with any drum having a side wall, a drum head and drum ring. Assembly comprises a solid santoprene adaptor (EDRC) that mounts to the underside of the drum ring and comes up the side and over the top, clipping to the drum ring while protruding approximately one inch in to the outer part of the drum head touching the drum head to stop the drum from making a ringing sound.

DETAILED DESCRIPTION OF THE INVENTION

Figure 1:
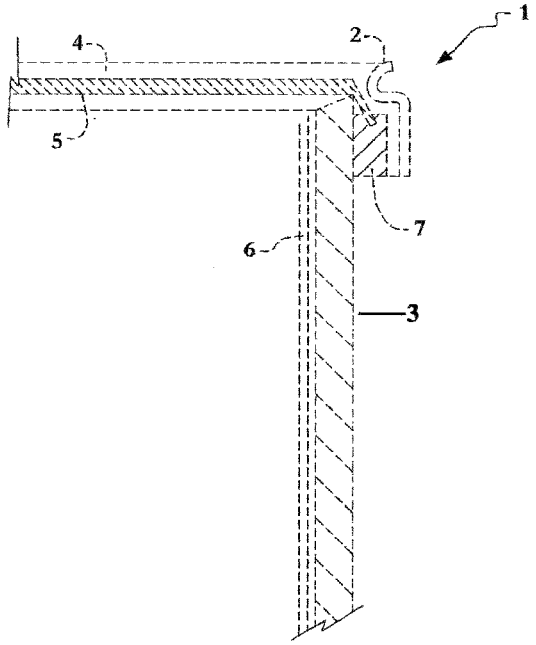
FIG. 1 is a schematic side view of a drum for use with the DrumClip External Drum Ring Control (EDRC).
Figure 2:
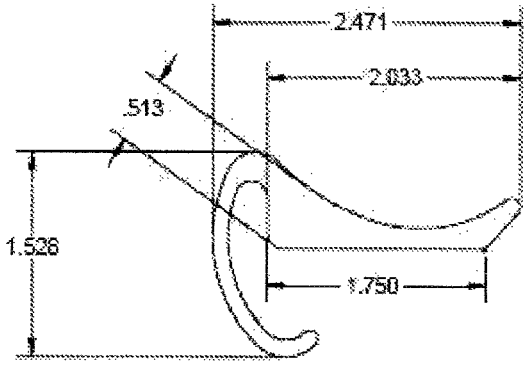
FIG. 2 shows the dimensions of the DrumClip External Drum Ring Control (EDRC) from a side view.
Figure 3:
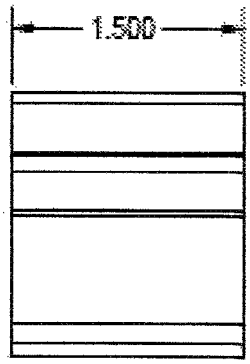
FIG. 3 shows the dimensions of the DrumClip External Drum Ring Control (EDRC) from the back side.
Figure 4:
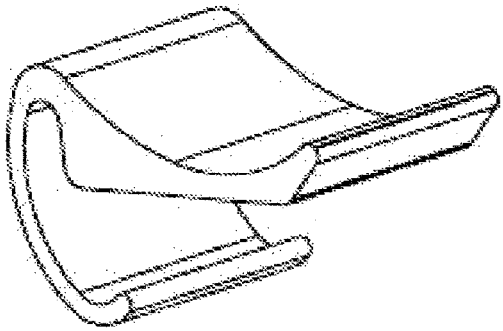
FIG. 4 shows a perspective view of the DrumClip External Drum Ring Control (EDRC).
Figure 5:
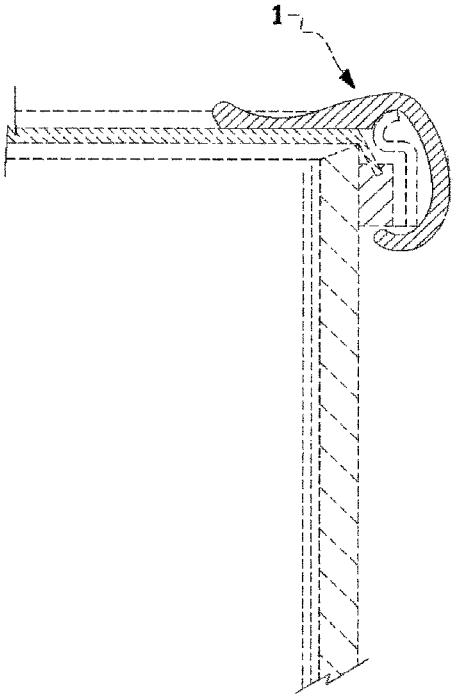
FIG. 5 is a schematic side view of the DrumClip External Drum Ring Control (EDRC) in place on the drum of FIG. 1.
Figure 6:
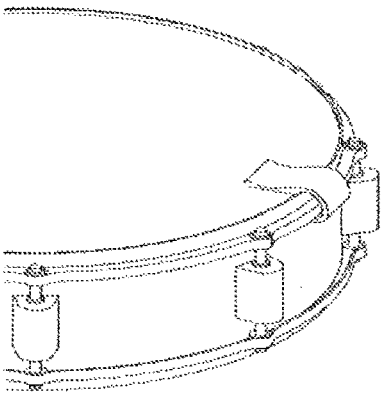
FIG. 6 is a perspective view of the DrumClip External Drum Ring Control (EDRC) on a drum.

FIG. 1 is a schematic side view of a drum 1 that the DrumClip External Drum Ring Control (EDRC) will go on. The drum 1 includes a shell 6, 3, which is typically wooden, and a drum head 5 at one open end of the shell, for example the top end (Batter Head). An aluminum ring 7 is connected to the drum head 5 to extend on and about the shell. The drum rim 2 is the edge of the drum rim and the side rim 4, typically made of metal, to hold the drum head 5 and the aluminum ring 7 in place and to put desired tension on the drum head 5.

For combination with any drum having a side wall, a drum head and drum ring. Assembly comprises a solid santoprene adaptor (EDRC) that mounts to the underside of the drum ring and comes up the side over the top clipping to the drum ring while protruding approximately one inch in to the outer part of the drum head touching the drum head to stop the drum from making a ringing sound.

This invention external drum ring control relates generally to a drumming apparatus, and more particularly to improvements to an auxiliary apparatus attachable to any drum, such as a snare drum, in respect of putting pressure on the outer part of the drum head to produce a more desired acoustic sound and taking away the ring that occurs when played.

It is a major object of the invention to provide an improved apparatus as referred to, for use in stopping the ring that occurs when a drum head has nothing on the outer part of the playing service; ERDC stops this from happening.

The advantages of this invention, as well as the details of an illustrative embodiment, will be more fully understood from the following specification and drawings.

That apparatus basically comprises a solid santoprene-made adaptor that hooks under any drum ring then comes up over the drum ring clipping on the ring while touching the drum head to stop the ringing.

The invention claimed is:

1. An adaptor for reducing acoustic ringing of a drum head of a drum having a shell and a rim, the rim having an outer diameter and configured to interface with a ring coupled to the drum head to hold the drum head in place on the shell, the adaptor comprising:

a monolithic body having a clip portion and a contact portion, the clip portion configured to extend around an outer section of the rim between a top surface of the drum head and a bottom portion of the rim, the clip portion having a clip end and the ring having an outer diameter, wherein the clip end is configured to extend to a position which is inward of the outer diameter of the ring when the clip portion is coupled to the drum; and wherein the contact portion comprises a contact surface configured to apply a pressure to a portion of the top surface of the drum head when the clip portion is coupled to the drum.

2. The adaptor of claim 1, wherein drum head has an outer diameter, and wherein a portion of the contact surface is configured to contact the top surface of the drum head at a point approximately one inch inward from the outer diameter of the drum head.

3. The adaptor of claim 2, wherein the outer diameter of the drum head is not equal to the outer diameter of the ring.

4. The adaptor of claim 1, wherein the monolithic body comprises santoprene.

5. The adaptor of claim 1, wherein the drum is a snare drum.

6. The adaptor of claim 1, wherein the contact portion has a generally rectangular shape.

7. The adaptor of claim 1, wherein the contact portion is defined by a first dimension extending in a radial direction along the drum head when the clip portion is coupled to the drum and a second dimension transverse to the first dimension, and wherein the first dimension is greater than the second dimension.

8. A drum having reduced acoustic ringing, comprising:

a shell;

a rim having an outer diameter and configured to hold a drum head to the shell at a desired tension, wherein the drum head includes a ring having an outer diameter;

an attachable adaptor having a monolithic structure and including a clip portion and a contact portion, the clip portion configured to extend around an outer section of the rim between a top surface of the drum head and a bottom portion of the rim, the clip portion having a clip end and the ring having an outer diameter, wherein the clip end is configured to extend to a position which is inward of the outer diameter of the ring when the clip portion is clipped in place relative to the drum head; and wherein the contact portion comprises a contact surface configured to apply a pressure to a portion of the top surface of the drum head when the clip portion is clipped in place relative to the drum head.

9. The drum of claim 8, wherein drum head has an outer diameter, and wherein a portion of the contact surface is configured to contact the top surface of the drum head at a point approximately one inch inward from the outer diameter of the drum head.

10. The drum of claim 9, wherein the outer diameter of the drum head is not equal to the outer diameter of the ring.

11. The drum of claim 8, wherein the monolithic structure comprises santoprene.

12. The drum of claim 8, wherein the drum is a snare drum.

13. The drum of claim 8, wherein the contact portion has a generally rectangular shape.

14. The drum of claim 8, wherein the contact portion is defined by a first dimension extending in a radial direction along the drum head when the clip portion is coupled to the drum and a second dimension transverse to the first dimension, and wherein the first dimension is greater than the second dimension.

15. The drum of claim 8, wherein the drum exhibits increased acoustic ringing when the attachable adaptor is not clipped in place relative to the drum head.

16. The drum of claim 8, wherein the shell comprises wood and the rim comprises a metal.

17. A method of producing an adaptor for reducing acoustic ringing of a drum head of a drum having a shell and a rim, the rim having an outer diameter and configured to interface with a ring coupled to the drum head in order to hold the drum head in place on the shell, the method comprising:

forming a monolithic body having a clip portion and a contact portion, the clip portion configured to extend around a section of the rim between a top surface of the drum head and a bottom portion of the rim, and wherein the contact portion comprises a contact surface configured to apply a pressure to a portion of the top surface of the drum head when the clip portion is coupled to the drum.

18. The method of claim 17, wherein the monolithic body comprises santoprene.

19. The method of claim 17, wherein the clip portion has a clip end and the ring has an outer diameter, and wherein the clip end is configured to contact the top surface of the drum head at a point approximately one inch inward from the outer diameter of the drum head.

20. The method of claim 17, wherein the clip end is configured to extend to a position which is inward of the outer diameter of the ring when the clip portion is coupled to the drum.

* * * * *

UNITED STATES PATENT AND TRADEMARK OFFICE

CERTIFICATE OF CORRECTION

PATENT NO. : 9,135,899 B2
APPLICATION NO. : 14/161130
DATED : September 15, 2015
INVENTOR(S) : Keith Jones It is certified that error appears in the above-identified patent and that said Letters Patent is hereby corrected as shown below:

Col. 2, Claim 2, Line 29: insert -- the -- before "drum head"

Signed and Sealed this
Seventeenth Day of May, 2016

Michelle K. Lee

Michelle K. Lee
*Director of the United States Patent and Trademark Office*